US011262781B2

(12) United States Patent
Sicard

(10) Patent No.: US 11,262,781 B2
(45) Date of Patent: Mar. 1, 2022

(54) VOLTAGE REFERENCE CIRCUIT FOR COUNTERING A TEMPERATURE DEPENDENT VOLTAGE BIAS

(71) Applicant: NXP USA, Inc., Austin, TX (US)

(72) Inventor: Thierry Michel Alain Sicard, Auzeville tolosane (FR)

(73) Assignee: NXP USA, Inc., Austin, TX (US)

( * ) Notice: Subject to any disclaimer, the term of this patent is extended or adjusted under 35 U.S.C. 154(b) by 10 days.

(21) Appl. No.: 16/813,838

(22) Filed: Mar. 10, 2020

(65) Prior Publication Data

US 2020/0301462 A1 Sep. 24, 2020

(30) Foreign Application Priority Data

Mar. 22, 2019 (EP) ..... 19305354

(51) Int. Cl.
*G05F 3/30* (2006.01)
*G05F 3/26* (2006.01)

(52) U.S. Cl.
CPC ..... *G05F 3/265* (2013.01); *G05F 3/30* (2013.01)

(58) Field of Classification Search
CPC ..... G05F 3/225; G05F 3/245; G05F 3/265; G05F 3/267; G05F 3/30; G05F 1/465; G05F 1/567
See application file for complete search history.

(56) References Cited

U.S. PATENT DOCUMENTS 4,249,122 A * 2/1981 Widlar ..... G05F 3/30 323/313
4,525,663 A 6/1985 Henry
4,626,770 A 12/1986 Price, Jr.
5,852,360 A * 12/1998 Levinson ..... G05F 3/245 323/316
6,052,020 A * 4/2000 Doyle ..... G05F 3/30 323/313
8,400,213 B2 3/2013 Sicard
8,816,756 B1 * 8/2014 Eberlein ..... G05F 3/30 327/539
9,110,485 B2 8/2015 Sicard
(Continued)

FOREIGN PATENT DOCUMENTS

DE 3321556 A1 12/1984
GB 2263794 A 8/1993
JP H05100757 A 4/1993

*Primary Examiner* — Thienvu V Tran
*Assistant Examiner* — Shahzeb K Ahmad

(57) ABSTRACT

A voltage reference circuit including a resistive track having a first force contact and a second force contact. The first and second force contacts configured to pass a current through the resistive track. A first sense contact, a second sense contact and a third sense contact are arranged at different positions along the resistive track between the first and second force contacts and the sense contacts are arranged to define a first resistor and a second resistor. A first component arrangement includes a P-N junction which has a temperature dependent voltage bias; a second component arrangement. One or both of the first component arrangement and the second component arrangement provide for a counter-bias voltage. The counter bias voltage counters the temperature dependent voltage bias of the P-N junction such that the voltage reference circuit provides a constant output reference voltage.

20 Claims, 9 Drawing Sheets

(56) References Cited

U.S. PATENT DOCUMENTS

| | | | | |
|---|---|---|---|---|
| 9,448,579 | B2 | 9/2016 | Marinca | |
| 10,496,122 | B1 * | 12/2019 | Gottapu | G05F 3/30 |
| 2004/0119528 | A1 * | 6/2004 | Rashid | G05F 3/225 327/538 |
| 2007/0296392 | A1 * | 12/2007 | Chen | G05F 3/30 323/313 |
| 2011/0068854 | A1 * | 3/2011 | Engl | G05F 3/30 327/512 |
| 2014/0306675 | A1 * | 10/2014 | Kohama | G05F 1/562 323/273 |
| 2016/0018839 | A1 * | 1/2016 | Cocetta | G05F 3/30 323/314 |
| 2016/0274617 | A1 * | 9/2016 | Wadhwa | G05F 3/30 |

* cited by examiner

VOLTAGE REFERENCE CIRCUIT FOR COUNTERING A TEMPERATURE DEPENDENT VOLTAGE BIAS

FIELD

The present disclosure relates to a voltage reference circuit. In particular, the present disclosure relates to a voltage reference circuit which provides a constant output voltage reference that is substantially invariant to contact resistance variations.

SUMMARY

According to a first aspect of the present disclosure there is provided a voltage reference circuit comprising:

a resistive track having:

a first force contact for coupling with a first supply voltage, and a second force contact for coupling to a second supply voltage, wherein the second supply voltage is different to the first supply voltage, and the first and second force contacts are configured to pass a current through the resistive track;

a first sense contact, a second sense contact and a third sense contact wherein each of the first, second and third sense contacts are arranged at different positions along the resistive track between the first force contact and the second force contact such that, of the sense contacts, the third sense contact is closest to the first force contact and wherein a first portion of the resistive track comprising the length between the first sense contact and the second sense contact defines a first resistor and a second portion of the resistive track comprising the length between the third sense contact and the closest of the first sense contact and the second sense contact to the third sense contact defines a second resistor;

a first component arrangement having a first terminal coupled to the second force contact of the resistive track; a second terminal for coupling to the second supply voltage; and a control terminal coupled to the first sense contact, the control terminal configured to control the flow of current between the first and second terminals of the first component arrangement based on a voltage at the control terminal, wherein the first component arrangement comprises a P-N junction which has a temperature dependent voltage bias;

a second component arrangement having a first terminal for coupling to one of the first supply voltage and the second supply voltage and a second terminal coupled to the second sense contact;

wherein one or both of the first component arrangement and the second component arrangement provide for a counter-bias voltage over the first or second resistor, the counter bias voltage for countering the temperature dependent voltage bias of the P-N junction and wherein the counter bias voltage is set by the ratio of the first resistance to the second resistance such that the voltage reference circuit is configured to provide a constant output reference voltage between the third sense contact and one of the first and second supply voltages.

It will be appreciated that, while the junction has been described as a P-N junction, this places no limitation on the order of the dopant materials and, as such, a P-N junction equally describes a junction which might be considered to have an order of positive-negative doping or negative-positive doping. Thus, it does not matter whether a bias voltage is applied from positive to negative or negative to positive in a P-N junction.

In one or more embodiments the first component arrangement may comprise a first component arrangement Bipolar Junction Transistor, BJT, wherein the first terminal of the first component arrangement may comprise a collector terminal of the first component arrangement BJT, the second terminal of the first component arrangement may comprise an emitter terminal of the first component arrangement BJT and the third terminal of the first component arrangement may comprise a base terminal of the first component arrangement BJT and wherein the P-N junction of the first component arrangement may comprise the base-emitter junction of the first component arrangement BJT.

In one or more embodiments the first component arrangement BJT may comprise a NPN BJT or a PNP BJT. In one or more embodiments the first component arrangement BJT may comprise an NPN BJT, the second supply voltage may comprise a lower supply voltage than the first supply voltage. In one or more embodiments the first component arrangement BJT may comprise a PNP BJT, the second supply voltage may comprise a higher supply voltage than the first supply voltage.

In one or more embodiments the first component arrangement may comprise: a first component arrangement Metal Oxide Semiconductor Field Effect Transistor, MOSFET, having a source terminal, a drain terminal and a gate terminal; a first component arrangement amplifier having a first input terminal, a second input terminal and an output terminal; and a first component arrangement diode having an input terminal and an output terminal, the diode comprising the P-N junction; wherein:

the first terminal of the first component arrangement may comprise the source terminal of the first component arrangement MOSFET;

the second terminal of the first component arrangement may comprise output terminal of the first component arrangement diode;

the control terminal of the first component arrangement may comprise the first input terminal of the first component arrangement amplifier;

the gate terminal of the first component arrangement MOSFET may be coupled to the output terminal of the first component arrangement amplifier;

the second input terminal of the first component arrangement amplifier may be coupled to the drain terminal of the first component arrangement MOSFET;

the second input terminal of the first component arrangement amplifier may be coupled to the input node of the first component arrangement diode and the drain terminal of the first component arrangement MOSFET may be coupled to one of the input terminal of the first component arrangement diode and the output terminal of the first component arrangement diode.

In one or more embodiments the second component arrangement may comprise a second component arrangement BJT, wherein the first terminal of the second component arrangement may comprise an emitter terminal of the second component arrangement BJT, the second terminal of the second component arrangement may comprise a base terminal of the second component arrangement BJT, and the second component arrangement may comprise a third terminal coupled, via a constant current source arrangement to a collector terminal of the second component arrangement BJT and the third terminal of the second component arrangement may be for coupling to the other of the first and second supply voltage, the arrangement of the first component arrangement and the second component arrangement such that they together provide for the counter bias voltage between the first sense contact and the second sense contact.

In one or more embodiments, the constant current source may comprise a current mirror or a Wilson current mirror arrangement.

In one or more embodiments the constant current source may comprise a current mirror arrangement and the current mirror arrangement may comprise a first current mirror BJT and a second current mirror BJT wherein a base of the first current mirror BJT and a base of the second current mirror BJT are coupled together, a collector terminal of the second current mirror BJT may be coupled to the collector of the second component arrangement BJT, an emitter terminal of the first current mirror BJT may be for coupling to the first supply voltage, an emitter terminal of the second current mirror BJT may be for coupling to the first supply voltage and the gate terminals of the first and second current mirror BJTs are further coupled to the collector terminal of one of the first current mirror BJT and the second current mirror BJT.

In one or more embodiments, a collector terminal of the first current mirror BJT may be coupled to the first force contact of the resistive track. In one or more embodiments, a collector terminal of the first current mirror BJT may be coupled to a collector terminal of a third current mirror BJT, the third current mirror BJT having an emitter terminal coupled to the first force contact of the resistive track and the third current mirror BJT further having a base terminal coupled to the collector terminals of the second current mirror BJT and the second component arrangement BJT.

In one or more embodiments the second component arrangement may comprise a second component arrangement amplifier, wherein the first terminal of the second component arrangement may comprise an output terminal of the second component arrangement amplifier, the second terminal of the second component arrangement comprises a first input of the second component arrangement amplifier, and the second component arrangement comprises a third terminal coupled to the coupled to one of the first sense contact and the third sense contact, the second component arrangement amplifier comprising a built-in-offset such that the second component arrangement provides for the counter bias voltage between the second and third sense contacts.

In one or more embodiments the second component arrangement may comprise a second component arrangement MOSFET having a source terminal, a drain terminal and a gate terminal; a second component arrangement amplifier comprising a first input terminal, a second input terminal and an output terminal; and a second component arrangement diode having an input terminal and an output terminal; and wherein the source terminal of the second component arrangement MOSFET may comprise the first terminal of the second component arrangement and is for coupling to the first supply voltage, the drain terminal of the second component arrangement MOSFET is coupled to the first force contact, the gate terminal of the second component arrangement MOSFET may be coupled to the output terminal of the second component arrangement amplifier, the first input node of the second component arrangement amplifier comprising the second terminal of the second component arrangement and the second input node of the second component arrangement amplifier comprising a third terminal of the second component arrangement, the third terminal of the second component arrangement coupled to the input node of the second component arrangement diode and the output node of the second component arrangement diode for coupling to the second supply voltage, wherein the arrangement of the first component arrangement and the second component arrangement may be such that they together provide for the counter bias voltage between the first sense contact and the second sense contact.

In one or more embodiments the voltage reference circuit may comprise a bandgap reference circuit and wherein the constant output reference voltage is provided between the third sense contact and the second supply voltage.

In one or more embodiments the voltage reference circuit may be a Zener voltage reference circuit and wherein first component arrangement may comprise a Zener diode having an output terminal coupled to the base of the first component arrangement BJT and to the first sense contact and the and an input terminal coupled to the first supply voltage.

In one or more embodiments, the voltage reference circuit may comprise a further BJT having a base terminal, an emitter terminal and a collector terminal, wherein the base terminal of the further BJT may be coupled to the base terminal of the first component arrangement BJT and the output node of the Zener diode, the emitter terminal of the further BJT may be for coupling to the second supply voltage and the collector terminal of the further BJT may be coupled to the output terminal of the Zener diode such that the further BJT and the first component arrangement BJT form a current mirror.

In one or more embodiments the resistive track may comprise a polysilicon resistive track. In one or more embodiments the resistive track may comprise a polysilicon deposit over an oxide layer of a substrate material.

In one or more embodiment the first sense contact may comprise a first sub-sense contact located at a first position along the resistive track, a second sub-sense contact positioned at a second position along the resistive track and a first switching apparatus, wherein the first switching apparatus may be configured to provide for switching of the first sense contact between the first sub-sense contact and the second sub-sense contact such that the length of the resistive track that provides the first resistor is altered.

In one or more embodiments the third sense contact may comprise a first sub-sense contact located at a third position along the resistive track, a second sub-sense contact positioned at a fourth position along the resistive track and a second switching apparatus, wherein the second switching apparatus may be configured to provide for switching of the first sense contact between the first sub-sense contact and the second sub-sense contact such that the length of the resistive track that provides the second resistor is altered.

In one or more embodiments the second sense contact may comprise a first sub-sense contact located at a fourth position along the resistive track, a second sub-sense contact positioned at a fifth position along the resistive track and a third switching apparatus, wherein the third switching apparatus may be configured to provide for switching of the second sense contact between the first sub-sense contact and the second sub-sense contact in order to alter the lengths of both the first and second resistors.

In one or more embodiments the distance between the first and second positions of the first sub-sense contact and the second sub-sense contact of the first sense contact may be different to the distance between the third and fourth positions of the first sub-sense contact and the second sub-sense contact of the third sense contact.

In one or more embodiments the voltage reference circuit may further comprise a matching resistor wherein:

the matching resistor is arranged between the first sense contact and the control terminal of the first component arrangement and wherein the matching resistor has a resistance configured to match the voltage drop between the first sense contact and the first component arrangement to that between the second sense contact and the second component arrangement; or the matching resistor is arranged between the third sense contact and a third terminal of the second component arrangement and wherein the matching resistor has a resistance configured to match the voltage drop between the third sense contact and the second component arrangement to that between the second sense contact and the second terminal of the second component arrangement.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF THE DRAWINGS

One or more embodiments will now be described by way of example only with reference to the accompanying drawings in which.

Figure 1:
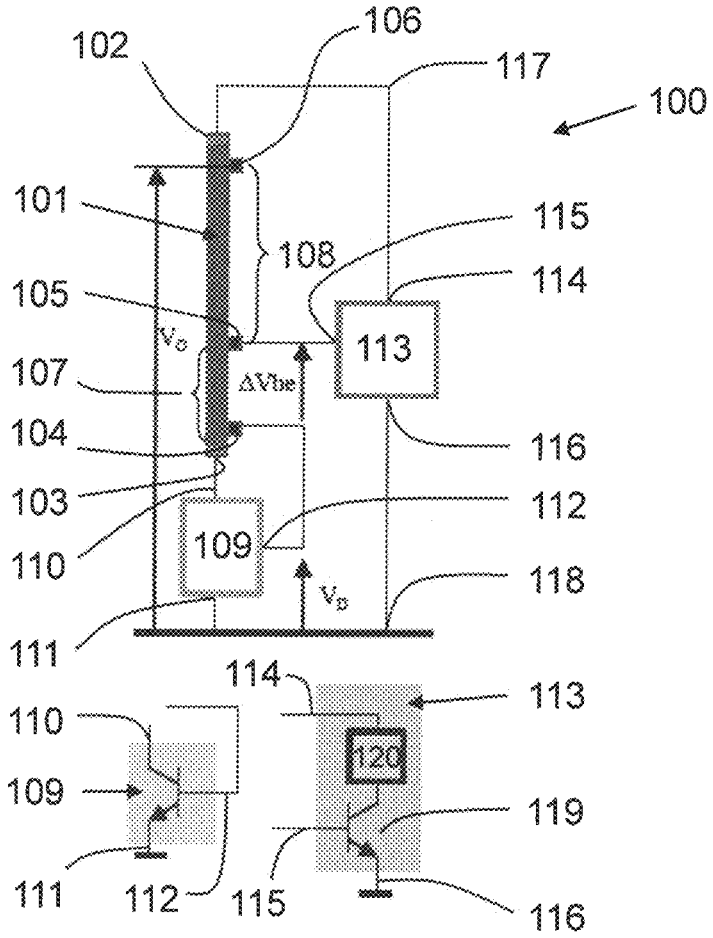
FIG. 1 shows an example first embodiment of a bandgap voltage reference circuit.

Accurate references are useful in a wide range of industries in order to allow for the proper measurement, processing and outputting of information. It is no surprise, therefore, that an accurate voltage reference is essential in almost all types of electronic applications including, but by no means limited to, applications such as signal processing and battery management systems. It is for this reason that a range of different types of reference voltage circuits have been designed over the years, including both bandgap reference voltage circuits and Zener diode reference voltage circuits.

Voltage reference circuits are designed to provide a constant voltage independent of temperature changes and power supply variations. However, the bandgap of P-N junctions has an inherent temperature dependent voltage bias which may typically be equal to −2 mV/K which results in a voltage drop of around 0.65V at room temperature. In order to obtain an accurate voltage reference circuit, it is necessary to provide a counter-bias voltage which counters, at least to first order, the temperature dependent voltage bias of the P-N junction. A voltage reference circuit may comprise: a first component arrangement which comprises a P-N junction; and a second component arrangement, wherein one or both of the first or second component arrangements are configured to provide for the counter-bias voltage over one of a first or second resistor. The magnitude of the counter-bias voltage can be tuned by adjusting the ratio of the resistances between the first and second resistors.

In the example of a bandgap reference voltage circuit, by purposefully choosing a ratio of the resistance of the first resistor to the resistance of the second resistor, it possible to allow for the temperature dependent voltage to be cancelled by the counter-bias voltage behaviour, thereby providing a voltage which is close to the theoretical bandgap of silicon at 0 Kelvin of 1.22 eV. The output voltage of a voltage reference circuit may be denoted as:

$$V_0 = V_D + \left(1 + \frac{R_2}{R_1}\right)\Delta V_{be} \tag{1}$$

where $V_0$ is the constant voltage output of the circuit, $V_D$ is the voltage across the P-N junction, such as a diode, which has an intrinsic temperature dependence, $R_1$ is the resistance of the first resistor, $R_2$ is the resistance of the second resistor, and $\Delta V_{be}$ is the voltage counter-bias voltage provided for by one or both of the first and second component arrangements. The target resistance ratio, $R_2/R_1$, which allows for tuning of $\Delta V_{be}$ may be referred to as a constant, k.

As time goes on, the voltage reference value of a voltage reference circuit may deviate from its originally designed value. One of the main factors which may lead to a deviation of the voltage reference value can be the variation in the contact resistance of the resistors which form an integral part of the voltage reference circuit. Environmental or operational impacts, such as mechanical or thermal stress or strain, may result in the deterioration of the contacts to the resistors and thereby a variation in the relative resistances of the first and second resistors. These variations in resistances may result in a change in the reference voltage, $V_0$. The relative error, $\varepsilon_x$, in $R_1$ may be described as a ratio of the deviation from $R_1$, $\Delta R_x$, to $R_1$: $\varepsilon_x=\Delta R_x/R_1$. The relative error, $\varepsilon_y$, in $R_2$ may be described as a ratio of the deviation from $R_2$, $\Delta R_y$, to $R_2$: $\varepsilon_y=\Delta R_y/R_2$. From equation (1) we see that the deviated reference voltage due to contact resistance variations becomes:

$$V_{out} = V_D + \left(1 + k\frac{1+\varepsilon_x}{1+\varepsilon_y}\right)\Delta V_{be} \tag{2}$$

The deviation of a voltage reference in some applications may not have a significant impact on the performance of the system in which the voltage reference is utilised. However, in safety critical applications, for example, the most stringent requirements may need to be met in terms of reference voltage accuracy and reliability. In safety critical systems, this error may not only be problematic but also fatal. In particular, lithium ion batteries for use in electric automotive vehicles may require particularly stable voltage reference signals which can remain reliable for 5, 10, 20 or more years and deviations may be unacceptable in such situations.

The present disclosure may provide devices which overcome one or more of the problems associated with resistance deviation resulting in reference voltage drift. In the present disclosure, there is provided a resistive track having a first force contact at a first end of the resistive track, and a second force contact at a second end of the resistive track, the first and second force contacts configured to pass a current through the resistive track. There is further provided a first sense contact, a second sense contact and a third sense contact, wherein each of the sense contacts are arranged at different positions along the resistive track between the first force contact and the second force contact. The portion of the resistive track between the first sense contact and the second sense contact defines a first resistor and the portion of the resistive track between the third sense contact and the closest of the first and second sense contact defines a second resistor. As will be described herein, the order of arrangement of the first and second force contact may be adjusted depending on the layout of the remaining components in the circuit. In some examples, the resistive track may comprise a track of polysilicon material which provides for a single resistive length of material. Because the resistors are defined by lengths of a single resistive track with no need for contact pads between the resistors, the resistances of the resistors can be exclusively defined by the length of resistors and, hence, k, can be also be defined exclusively by these lengths. By providing for such an arrangement, errors associated with the contacts between resistors may be mitigated. At least the first order effects of the contact errors may be compensated by using a single resistive track comprising first and second force contacts and first, second and third sense contacts. This arrangement may provide for an improvement of the ratio of the collector current to the base current, commonly referred to as μ, of more than 100 for the P-N junction.

It will be appreciated that force contacts are understood in the art to comprise electrical contacts which are configured in a circuit arrangement to drive a current therebetween, resulting in a voltage drop over any components arranged therebetween. In some examples, force contacts may otherwise be referred to as current leads. It will also be appreciated that sense contacts are understood in the art to comprise contacts with a high impedance such that a voltage drop may be measured thereover, but comparatively little current will flow through the sense contacts when compared to the current flowing between two connected force contacts. Sense contacts may be generally arranged between a first and second force contact and on either side of an impedance to be measured. In such a configuration, the sense contacts will be able to measure a voltage drop over the impedance to be measured without interrupting the operation of the impedance being measured. The current flowing through sense contacts may be ten times less, a hundred times less or a thousand times less than the current flowing between the force contacts. In other embodiments, the current flowing through the sense contacts may be even lower when compared to that flowing between the force contacts.

FIGS. 1-16 exemplify a large variety of possible arrangements for a constant reference voltage output using a single resistive track having resistors defined by lengths of the resistive track. It will be appreciated that the examples provided in FIGS. 1-16 show just a subset of all of the possible arrangements that may be particularly advantageous. It will be further appreciated that some of the individual embodiments described herein may provide for additional advantages over other embodiments beyond the invariance due to resistor contact drift.

As shown in FIG. 1, in one or more embodiments there is provided a voltage reference circuit 100 comprising a resistive track 101 having first and second force contacts 102, 103, and first, second and third sense contacts 104, 105, 106. Each of the first, second and third sense contacts 104, 105, 106 are arranged at different positions along the resistive track between the first and second force contacts 102, 103. A first resistor 107 is defined by a first portion of the resistive track 101 comprising the length between the first sense contact 104 and the second sense contact 105. In this and other embodiments, a second resistor 108 is defined by a second portion of the resistive track comprising the length between the second sense 105 contact and the third sense contact 106.

The voltage reference circuit 100 further comprises a first component arrangement 109 which comprises a P-N junction which has a temperature dependent voltage bias. The first component arrangement 109 comprises a first terminal 110 and a second terminal 111 between through which current from the resistive track 101 flows. The first component arrangement 109 further comprises a control terminal 112 which is configured to provide control of the flow of current between the first and second terminals 110, 111 of the first control arrangement 109.

The voltage reference circuit 100 also comprises a second component arrangement 113 configured to generate the counter-bias voltage, $\Delta V_{be}$, over the first resistor which provides for cancelation of the temperature dependent voltage, $V_D$, in the constant output reference voltage, $V_o$. The second component arrangement 113 comprises a first terminal 114 coupled to the first supply voltage 117, a second terminal 115 coupled to the second sense contact 105 and a third terminal 116 coupled to the second supply voltage 118. As will be seen later, the first terminal 114 of the second component arrangement 113 may be coupled to either of the first or second supply voltages 117, 118 and the third terminal 115 of the second component arrangement 113 may be coupled to the other of the first or second supply voltages 117, 118, or the third terminal 115 of the second component arrangement 113 may be coupled to the third sense contact 106.

As shown in FIG. 1, in one or more example embodiments, the first component arrangement 109 may comprise an NPN first component arrangement bipolar junction transistor (BJT). The first component arrangement BJT comprises a collector terminal which is the first terminal 110 of the first component arrangement 109, an emitter terminal which is the second terminal 111 of the first component arrangement 109, and a base terminal which is the third terminal 112 of the first component arrangement 109. By coupling the base terminal of the first component arrangement BJT to the first sense contact 104, the first sense contact provides a high impedance contact compared to the impedance of the resistive track 101 between the first and second force contacts 102, 103. In this embodiment, the P-N junction comprises the base-emitter junction of the first component arrangement BJT.

The arrangement of the first component arrangement BJT in the voltage reference circuit 100 as the first component arrangement 109 without any attempt to compensate for the temperature dependent voltage bias results in a temperature dependent reference voltage. While a BJT is shown in FIG. 1 as the first component arrangement 109, it will be appreciated that other components may take the place of the BJT in order to provide for control of the flow of current through the resistive track 101.

As shown in FIG. 1, the second component arrangement 113 may comprise a second component arrangement bipolar junction transistor (BJT) 119 and a constant current source arrangement 120. The second component arrangement BJT 119 comprises a collector terminal which is coupled to a second terminal of the constant current source 120, an emitter terminal which is the third terminal 116 of the second component arrangement 113, and a base terminal which is the second terminal 115 of the second component arrangement 113. The constant current source 120 also has a first terminal which is coupled to the first supply voltage 117. By coupling the base terminal of the second component arrangement BJT 119 to the second sense contact 104, a high impedance path is provided compared to the impedance of the resistive track between the first and second force contacts 102, 103. The arrangement of the second component arrangement BJT 119 in combination with the first component arrangement BJT in the voltage reference circuit 100 and with the constant current source 120, results in the provision of a voltage that is provides for the counter-bias voltage over one of the first resistor 107 and the second resistor 108. In the example of FIG. 1, the first component arrangement BJT and the second component arrangement BJT set the voltages and the first and second sense contacts and thereby cause the provision of $\Delta V_{be}$ over the first resistor 107. While the combination of a second component arrangement BJT 119 and a constant current source 120 is shown in FIG. 1 as the second component arrangement 113, it will be appreciated that other components may take the place of these components in order to provide for $\Delta V_{be}$.

By way of the arrangement of the components of the voltage reference circuit 100, as described with reference to FIG. 1, each of temperature dependent voltage bias and the counter-bias voltage may be proportional to absolute temperature (PTAT) or complimentary to absolute temperature (CTAT). By way of either adding a CTAT voltage and a PTAT voltage together or subtracting a CTAT voltage from another CTAT voltage or subtracting a PTAT voltage from another PTAT voltage, the temperature dependence of the reference voltage is cancelled out such that the voltage between the third sense contact 106 and the second voltage supply 118 is independent of temperature and, due to the lack of electrical force contacts between the first and second resistors 107, 108, also independent of contact resistance variations.

It will be appreciated that, where a voltage reference circuit is described herein as couplable to a first or second supply line, or for coupling to a first or second supply line, that a voltage reference circuit may be distributed without a connection to a voltage source or ground. As such, while the specific embodiments described herein describe the voltage reference circuits as coupled to each of the two voltage supply lines, it will be understood that the circuit is described in use, but that this connection is not necessary to provide a circuit that infringes claims for coupling to reference voltages. In the embodiment described with reference to FIG. 1, the first supply voltage may comprise a higher voltage level (a higher potential) than the second supply voltage. In some examples, the second supply voltage may comprise a ground voltage level.

Figure 2:
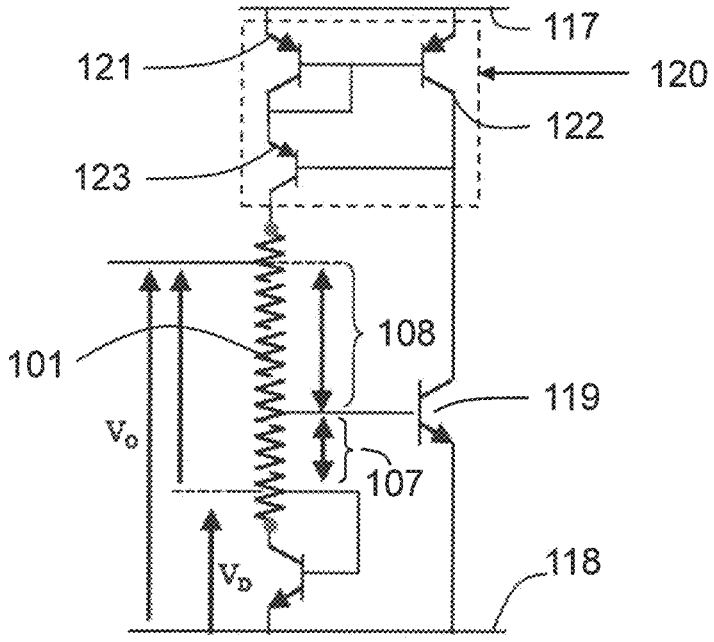
FIG. 2 shows a more detailed schematic representation of the example embodiment of FIG. 1.

As shown in FIG. 2, a schematic representation of the voltage reference circuit 100 of FIG. 1 is provided. The components of FIG. 2 have been labelled with corresponding reference numerals to those of FIG. 1 for ease of reference. In this example, the constant current source 120 comprises a current mirror and is coupled to a third current mirror BJT 123. The current mirror comprises first and second current mirror BJTs 121, 122 with coupled bases and a feedback line coupled from a collector of the current mirror's first BJT 121 to the bases of the current mirror BJTs 121, 122. The current mirror provides a constant current from the collectors of the first and second current mirror BJTs 121, 122. The output currents of the respective first and second current mirror BJTs 121, 122 may differ as a ratio of the size of the bases of the BJTs 121, 122 used to form the current mirror 120. The use of the current mirror may ensure that the output voltage of the voltage reference circuit 100 is independent of variations in the supply current at the first supply voltage 117. The third current mirror BJT 123, which comprises a PNP BJT, may provide for additional control of the current over resistive track 101 based on the voltage at the base of the second component arrangement BJT 119. The first, second and third current mirror BJTs together provide for a Wilson current mirror. A Wilson current mirror provides a higher output impedance, which provides for a stable constant current output which is more resistant to voltage changes at its input than a current mirror comprising only two BJTs, although such a current mirror may be used instead of a Wilson current mirror. The current mirror arrangement serves to copy the current at the collector of the second component arrangement BJT and to force this current on the resistive track 101. In some embodiments, the area of the first component arrangement BJT may be larger than the area of the second component arrangement BJT which results in a difference in the current densities thereover. This results in the voltage at the first sense node being less than that at the second sense node, thereby resulting in counter-bias voltage $\Delta V_{be}$. In some embodiments, the size of the first component arrangement BJT and the second current arrangement BJT are different, for example, the size of the bases of the BJTs are different. This difference in the size of the base terminals may result in a difference in the current densities at each of the first and second component arrangement BJTs and, as a result, the counter-bias voltage, $\Delta V_{be}$, may be generated.

In the examples described with reference to FIGS. 1 and 2, the constant voltage reference $V_0$ is defined as the voltage between the third sense contact and the second supply voltage and the magnitude of the counter-bias voltage, $\Delta V_{be}$, is tuned by the selection of the resistances of resistors $R_1$ and $R_2$, the voltage drop over the first component arrangement BJT and the temperature dependent voltage bias, $V_D$. By way of control of the currents over the resistive track 101 by the first component arrangement 109 and the second component arrangement 113, a reliable constant voltage source may be provided which is independent of temperature and contact resistance variations.

Figure 3:
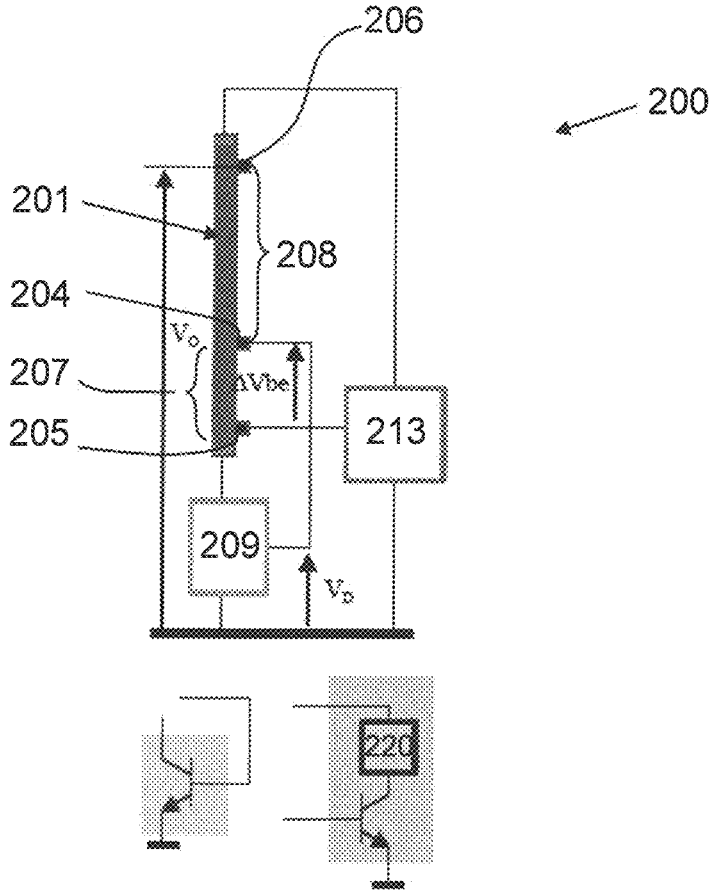
FIG. 3 shows an example second embodiment of a bandgap voltage reference circuit.

As shown in FIG. 3, there may be provided a second embodiment of a voltage reference circuit 200 which is similar in structure to that of the first embodiment. In this embodiment, the order of the first and second sense contacts 204, 205 along the resistive track 201 have been swapped. Thus, in this example, the first resistor 207 is defined by the portion of the resistive track between the first and second sense contacts 204, 205 and the second resistor 208 is defined by the portion of the resistive track between the first and third sense contacts 204, 206.

Figure 4:
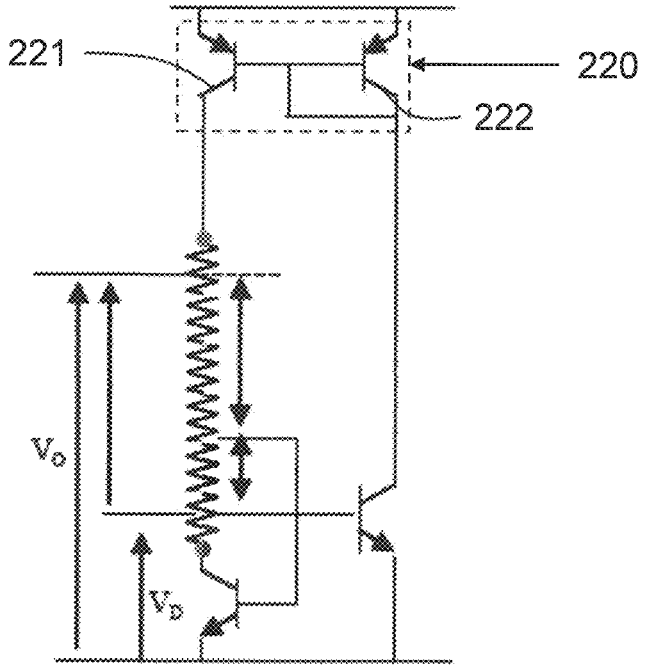
FIG. 4 shows a more detailed schematic representation of the example embodiment of FIG. 3.

As shown in FIG. 4, the constant current source 220 of this embodiment comprises a current mirror having a first and second current mirror BJTs 221, 222 with coupled bases and a feedback line coupled from a collector of the current mirror's second BJT 222 to the bases of the current mirror BJTs 221, 222.

In the examples described with reference to FIGS. 3 and 4, the constant voltage reference $V_0$ is defined between the third sense contact and the second supply voltage with reference to the resistances, $R_1$ and $R_2$, of the resistors 207, 208, the voltage drop over the first component arrangement BJT, $V_D$, and the voltage drop over the first resistor 207, $\Delta V_{be}$. By way of control of the currents over the resistive track 201 by the first component arrangement 209 and the second component arrangement 213, a reliable constant voltage source may be provided which is independent of temperature and contact resistance variations.

Figure 5:
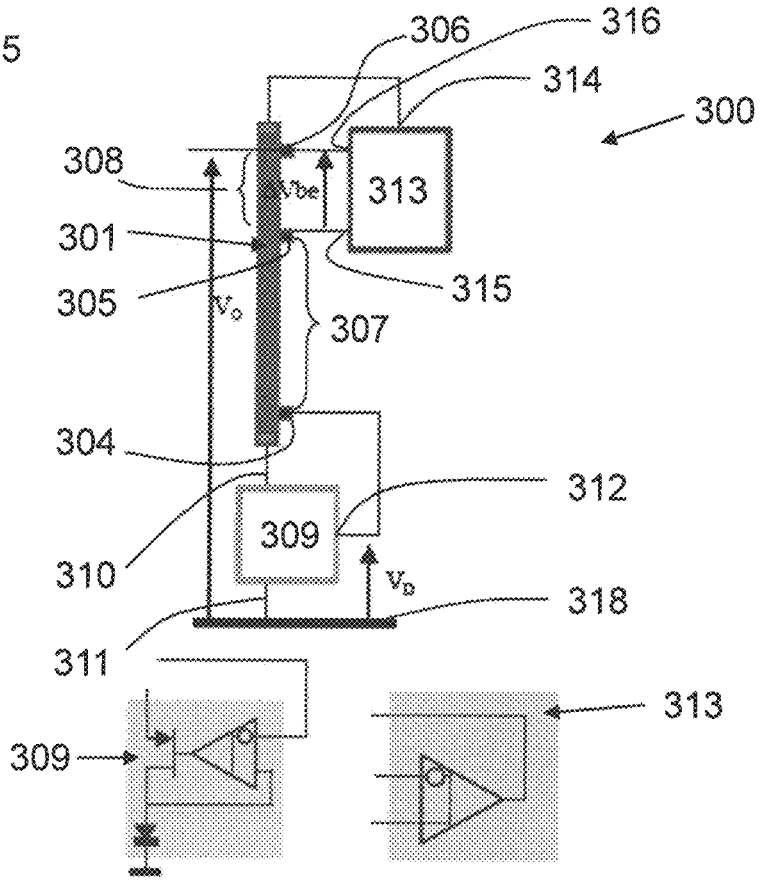
FIG. 5 shows an example third embodiment of a bandgap voltage reference circuit.

As shown in FIG. 5, in another embodiment of a voltage reference circuit 300, the third terminal 316 of the second component arrangement 313 may be coupled to the third sense contact 306. This embodiment may be particularly advantageous where the second component arrangement 313 comprises an amplifier such as a built-in-offset amplifier. The built-in-offset of the second component arrangement 313 provides, between the second and third sense contacts, the counter bias voltage, $\Delta V_{be}$. In this arrangement, the first resistor 307 having resistance $R_1$ comprises the portion of the resistive track 301 between the first and second sense contacts 304, 305. The second resistor 308 having resistance $R_2$ comprises the portion of the resistive track 301 between the second and the third sense contacts 305, 306.

In this embodiment, the first component arrangement 309 may comprise a first component arrangement metal oxide semiconductor field effect transistor (MOSFET) having a source terminal, a drain terminal and a gate terminal; a first component arrangement amplifier having a first input terminal, a second input terminal and an output terminal; and a first component arrangement diode having an input terminal and an output terminal. In this example, the source terminal of the first component arrangement MOSFET is the first terminal 310 of the first component arrangement, the drain terminal of the first component arrangement MOSFET is coupled to the input terminal of the first component arrangement diode, the gate terminal of the first component arrangement MOSFET is coupled to the output terminal of the first component arrangement amplifier. The first input terminal of the first component arrangement amplifier is the control terminal 312 of the first component arrangement 309, the second input terminal of the first component arrangement amplifier is coupled to both the drain terminal of the first component arrangement MOSFET and to the input terminal of the first component arrangement diode. The output terminal of the first component arrangement diode comprises the second terminal of the first component arrangement 311 which is coupled to the second supply voltage 318. The first component arrangement diode may be oriented such that it is configured to allow for the flow of current from the resistive track 301 to flow to the second supply voltage 318 but such that flow of current from the second supply voltage 318 back to the resistive track 301 is restricted.

The second component arrangement 313 of this embodiment comprises a second component arrangement amplifier, such as a built-in-offset amplifier, having a first and second input nodes and an output node. The built-in-offset amplifier may comprise at least two BJTs which are configured to have different current densities by way of having different sizes or different currents provided to them. The input terminals of the built-in-offset amplifier may comprise the base terminals of the at least two BJTs, which provide for a high impedance path between the second sense contact and the built-in-offset amplifier or the third sense contact and the built-in-offset amplifier. For example, the offset of the built-in-offset amplifier may be equal to 60 mV at room temperature. In this embodiment, the output node of the second component arrangement amplifier comprises the first terminal 314 of the second component arrangement 313. The second terminal 315 of the second component arrangement 313 comprises a second input terminal of the second component arrangement amplifier coupled to the second sense contact 305 and the third terminal 316 of the second component arrangement 313 comprises a first input of the second component arrangement amplifier coupled to the third sense contact 306.

Figure 6:
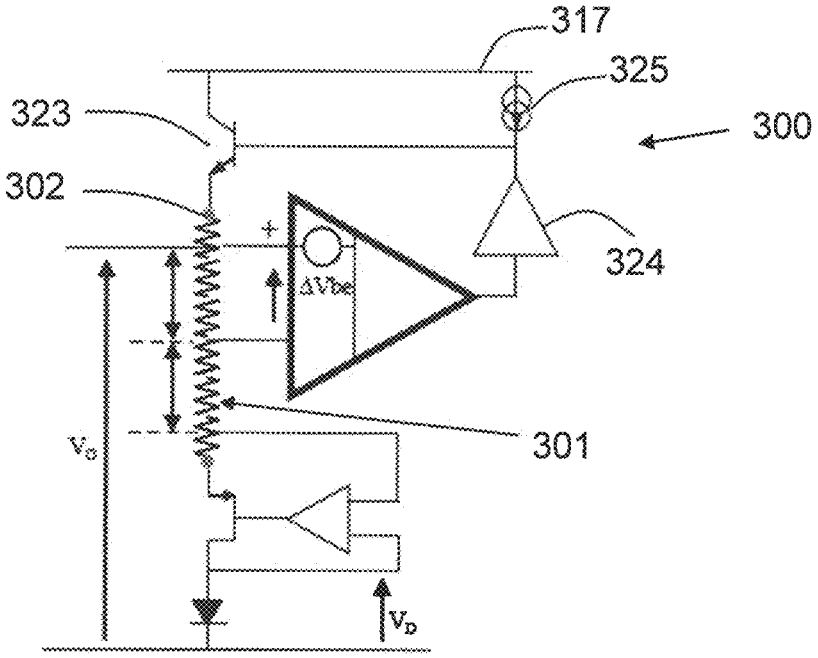
FIG. 6 shows a more detailed schematic representation of the example embodiment of FIG. 5.

As shown in FIG. 6, a schematic representation of the voltage reference circuit 300 of FIG. 5 is provided. The components of FIG. 6 have been labelled with corresponding reference numerals to FIG. 5 for ease of reference. In this example, a buffer amplifier 324 having a first input terminal coupled to the output terminal of the second component arrangement amplifier is provided having an output terminal coupled to both a constant current source 325 and the base terminal of a further BJT 323. The further BJT 323 also comprises a collector terminal coupled to the first supply voltage 317 and an emitter terminal coupled to the first force contact 302 of the resistive track 301. The buffer amplifier 324 provides a buffer such that the second component arrangement amplifier can drive the base terminal of the further transistor 323 directly. By way of this closed loop arrangement, the second component arrangement amplifier provides for control of the flow of current from the first supply voltage 317 to the resistive track 301 to provide the counter-bias voltage, $\Delta V_{be}$, over the second resistor in order to provide for countering the temperature dependent voltage bias of the P-N junction. In some examples, the second component arrangement amplifier may comprise first and second amplifier transistors where the size of the bases of the first and second amplifier transistors are different and wherein the ratio of the difference in the sizes of the bases of the first and second transistors determines the magnitude of $\Delta V_{be}$. In this way, $V_D$ and $\Delta V_{be}$ are controlled and, due to the tuning of the relative resistances of $R_1$ and $R_2$, a constant voltage is provided between the third sense contact 306 and the second supply voltage 318 which is independent of temperature and contact resistance variations.

Figure 7:
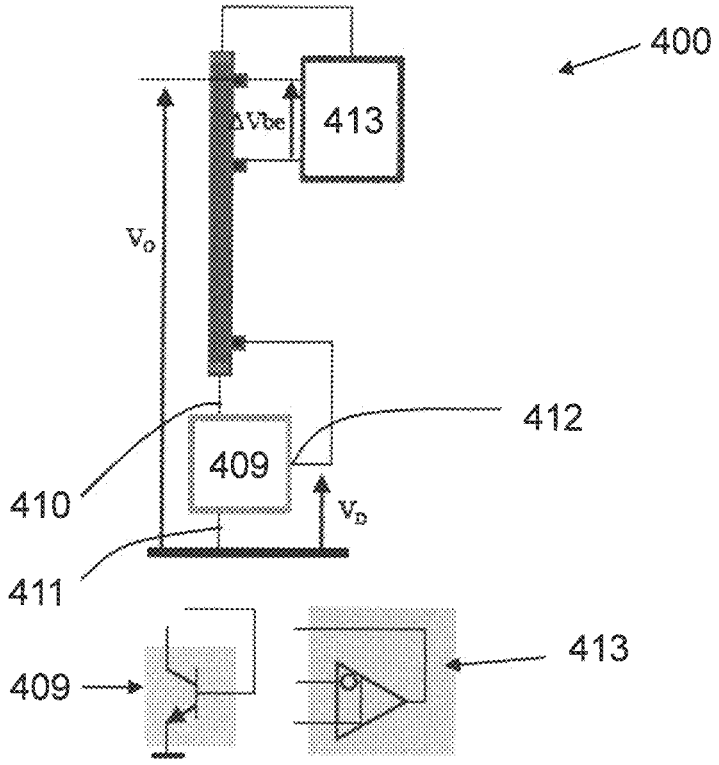
FIG. 7 shows an example fourth embodiment of a bandgap voltage reference circuit.

As shown in FIG. 7, there is provided another embodiment of a voltage reference circuit 400 which is structurally similar to that of FIG. 5. In this embodiment, the first component arrangement 409 comprises a first component arrangement BJT having a collector terminal comprising the first terminal 410 of the first component arrangement 409, an emitter terminal comprising the second terminal 411 of the first component arrangement 409 and a base terminal comprising the third terminal 412 of the first component arrangement 409. While the first component arrangement 409 has been demonstrated herein as being provided by a BJT, an amplifier and a MOSFET and diode arrangement, it will be appreciated that other components or combinations of components may provide for the first component arrangement 409.

Figure 8:
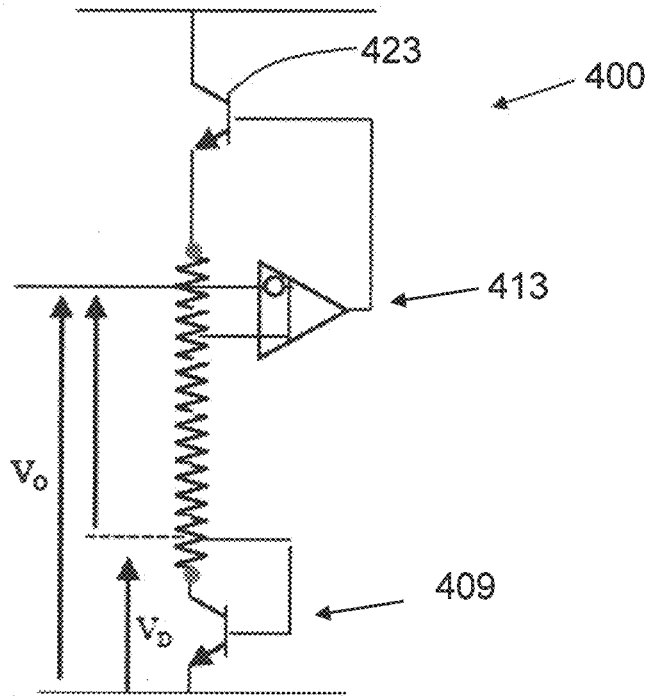
FIG. 8 shows a more detailed schematic representation of the example embodiment of FIG. 7.

As shown in FIG. 8, a schematic representation of the voltage reference circuit 400 of FIG. 7 is provided. As shown in this embodiment, the output of the second component arrangement built-in-offset amplifier of the second component arrangement 413 is used to control the further BJT 423 in order to provide for the counter-bias voltage between the second and third sense contacts by way of the built-in-offset. In some examples, the voltage reference circuit 400 of this embodiment may further comprise a buffer amplifier arranged between the second component arrangement amplifier and the base terminal of the further BJT 423. Other than the provision of a different first component arrangement 409, this embodiment provides for a voltage reference circuit 400 in the same manner as the embodiment described with reference to FIGS. 5 and 6.

Figure 9:
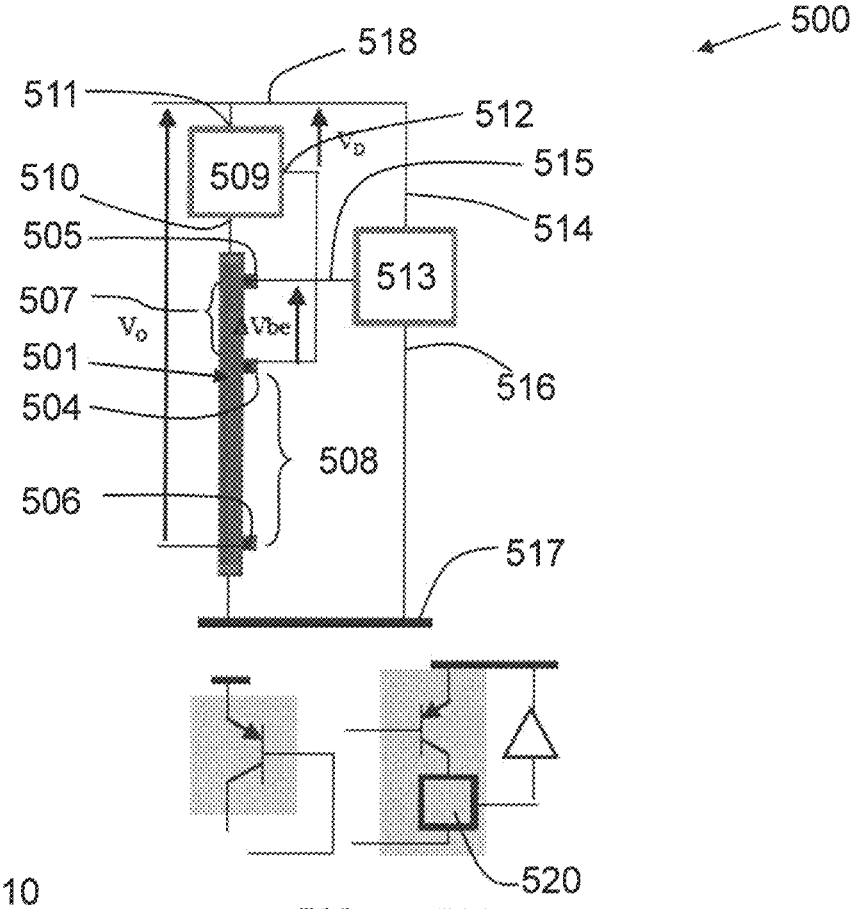
FIG. 9 shows an example fifth embodiment of a bandgap voltage reference circuit.

As shown in FIG. 9, there is another embodiment of a voltage reference circuit 500 which is structurally similar to that of FIG. 2, however, in this arrangement, the first component arrangement 509 and second component arrangement 513 comprise PNP BJTs instead of NPN BJTs, as have been used in the embodiments described with reference to FIGS. 1-8. Thus, where the second voltage supply 118, 218, 318, 418 was lower (had a lower potential) than the first voltage supply 117, 217, 317, 417 in the examples of FIGS. 1-8, in this example, the second voltage supply 518 is higher than the first voltage supply 517. In this embodiment, the first component arrangement 509 comprises a PNP first component arrangement BJT having an emitter terminal comprising the second terminal 511 of the first component arrangement 509 coupled to the second voltage supply 518, a collector terminal comprising the first terminal 510 of the first component arrangement 509 coupled to the second force contact 503 and a base terminal comprising the control terminal 512 of the first component arrangement 509 coupled to the first sense contact 504.

The second component arrangement 513 comprises a PNP second component arrangement BJT having an emitter terminal comprising the first terminal 514 of the second component arrangement 513 coupled to the second supply voltage 518, a collector terminal comprising the third terminal 516 of the second component arrangement 513 coupled to the first contact of a constant current arrangement 520 and a base terminal comprising the second terminal 515 of the second component arrangement 513 and coupled to the second sense contact 505. The constant current arrangement 520 comprising a second terminal coupled to the first voltage supply 517.

In this embodiment, the first resistor 507 comprises the portion of the resistive track 501 from the first sense contact 503 to the second sense contact 504 and the second resistor 508 comprises the portion of the resistive track 501 from the first sense contact 504 to the third sense contact 506 and the output constant reference voltage is measured between the third sense contact 506 and the second supply voltage 518. This embodiment provides an example wherein the second supply voltage 518 may be at a higher potential than the first supply voltage 517 and where the constant reference voltage is measured between the third sense contact 506 and the higher potential supply voltage, the second supply voltage 518 in this case.

Figure 10:
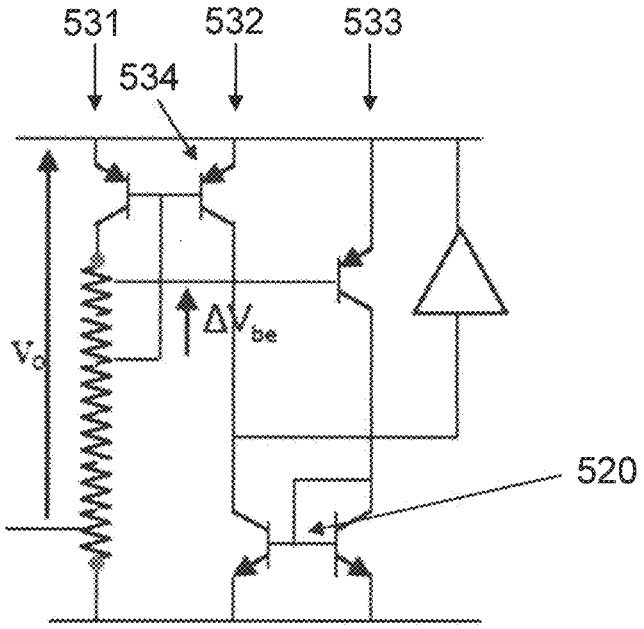
FIG. 10 shows a more detailed schematic representation of the example embodiment of FIG. 9.

As shown in FIG. 10, there is provided a schematic representation of the circuit of FIG. 9. In this embodiment, the voltage reference circuit 500 comprises first, second and third branches 531, 532, 533 wherein the first branch 531 comprises the resistive track 501 and the first component arrangement BJT. The third branch 533 comprises the second component arrangement BJT coupled to the second sense contact 505. All three branches 531, 532, 533 of the voltage reference circuit 500 should have the same or substantially the same current. The current mirror 520 of the second component arrangement 513 is coupled to both the second branch 532 and the third branch 533 and is configured to force the same current in the second and third branches 532, 533. The first component arrangement BJT and a further first component arrangement BJT 534 are arranged as a second current mirror coupled to the first and second branches 531, 532, respectively, with the collector of the further first component arrangement BJT 534 coupled to the collector of the BJT of one of the current mirror 520 along the second branch 532. The current mirror arrangement comprising the first component arrangement BJT and the further first component arrangement BJT 534 forces the first branch 531 to have the same current as the second branch 532 and, in this way, each of the first, second and third branches 531, 532, 533 have the same current therethrough. Because the current through each of the branches is equal but the first component arrangement BJT and the second component arrangement BJT may comprise different sizes of base terminal, the counter-bias voltage, $\Delta V_{be}$, is applied between the first and second sense contacts. By the application of the counter-bias voltage, the temperature dependent voltage bias of P-N junction of the first component arrangement BJT is countered and a constant voltage output signal can be provided between the third sense contact and the second supply voltage.

Figure 11:
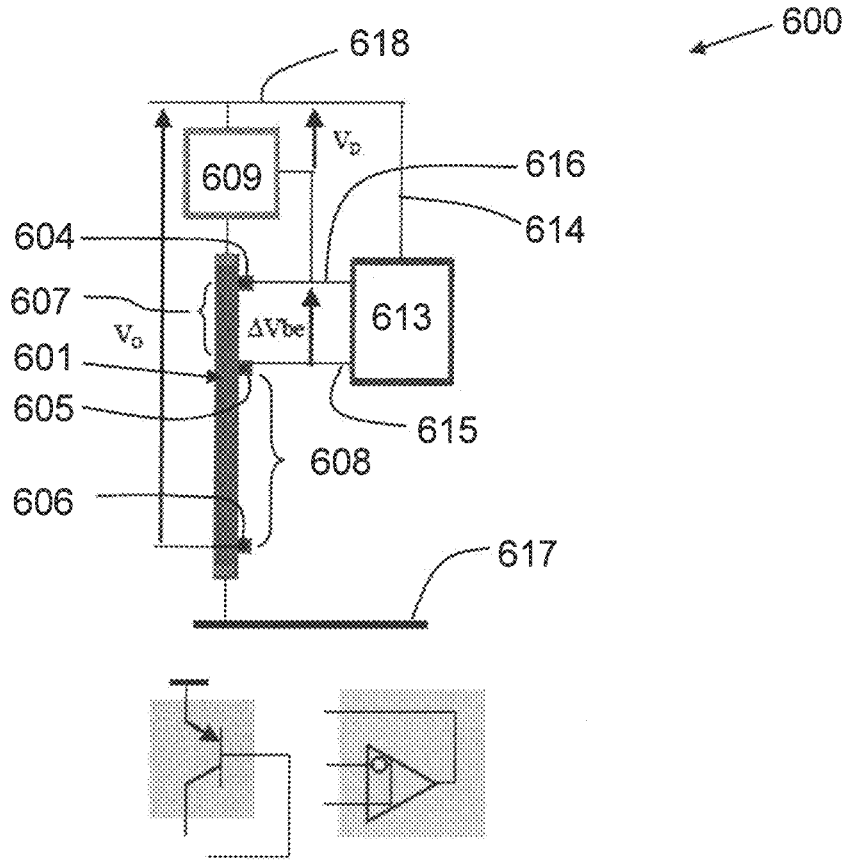
FIG. 11 shows an example sixth embodiment of a bandgap voltage reference circuit.
Figure 12:
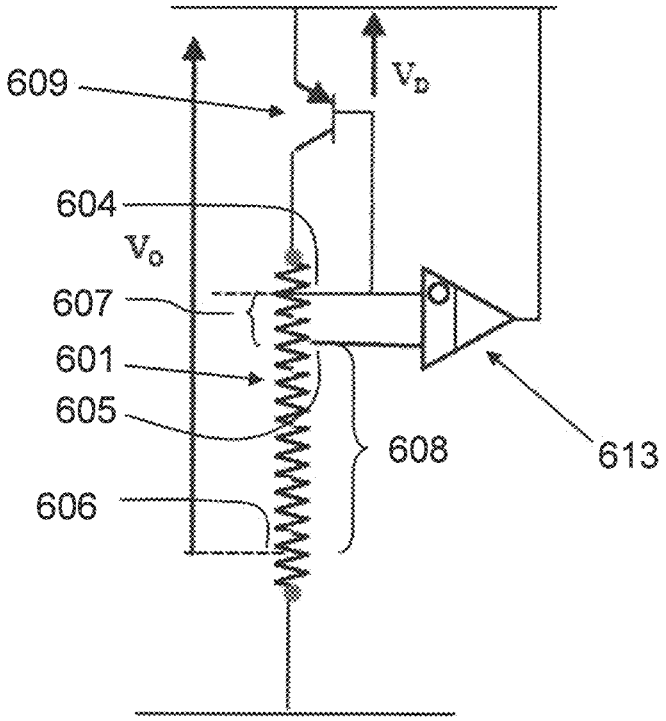
FIG. 12 shows a more detailed schematic representation of the example embodiment of FIG. 11.

As shown in FIGS. 11 and 12, there is provided an embodiment of a voltage reference circuit 600 which is structurally similar to that described with reference to FIGS. 7 and 8 wherein a BJT is used in the first component arrangement 409 and an amplifier, such as a built-in-offset amplifier, is used in the second component arrangement 413. In this embodiment, the first component arrangement BJT of the first component arrangement 609 comprises a PNP first component arrangement BJT, whereas the first component arrangement BJT of FIGS. 7 and 8 comprised an NPN BJT. Because the first component arrangement BJT of the first component arrangement 609 of this embodiment comprises a PNP first component arrangement BJT, the second supply voltage 618 comprises a higher potential than the first supply voltage 617 and the constant output voltage, $V_0$, is measured between the third sense contact 606 and the second supply voltage 618.

In this embodiment, the first terminal 614 of the second component arrangement 613, which comprises the output terminal of the second component arrangement amplifier, is coupled to the second supply voltage 618. The second terminal 615 of the second component arrangement 613 comprises a first input terminal to the second component arrangement amplifier and is coupled to the second sense contact 605. The third terminal 616 of the second component arrangement 613 comprises a second input terminal of the second component arrangement amplifier coupled to the first sense contact 604.

As a result of the configuration of the first and second component arrangements 609, 613 of this embodiment, the first resistor 607 of this embodiment comprises the portion of the resistive track 601 from the first sense contact 604 to the second sense contact 605 and the second resistor 608 comprises the portion of the resistive track 601 from the second sense contact 605 to the third sense contact 606. $\Delta V_{be}$ in this embodiment comprises the voltage drop over the first resistor 607.

Figure 13:
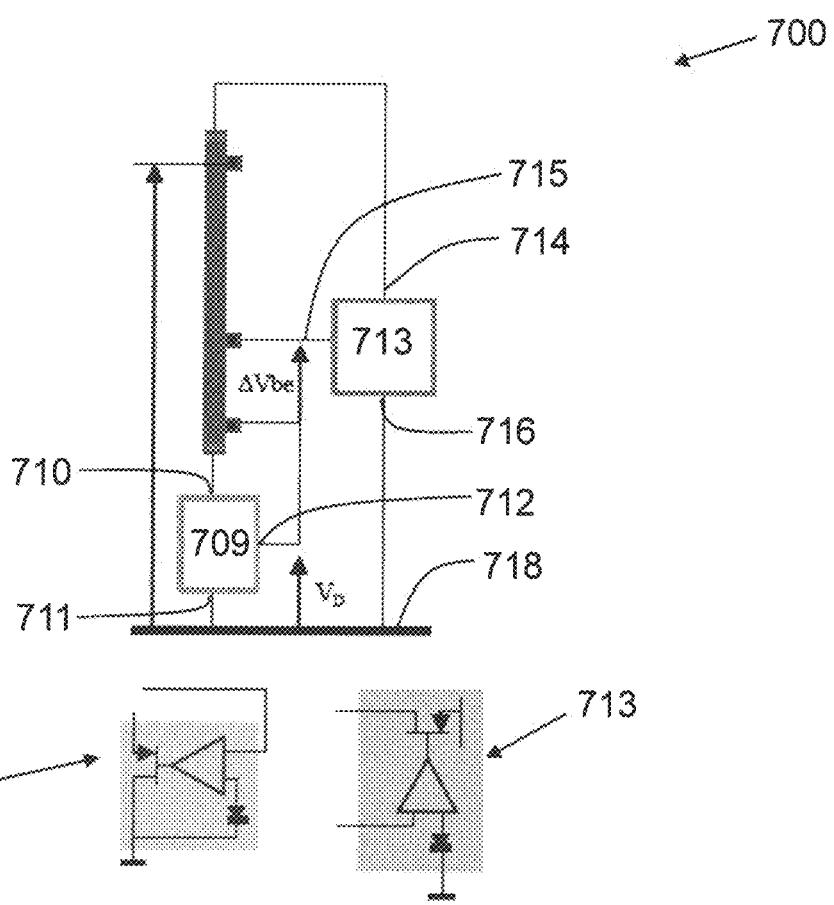
FIG. 13 shows an example seventh embodiment of a bandgap voltage reference circuit.

As shown in FIG. 13, there is provided an embodiment of a voltage reference circuit 700 which is structurally similar to that described with reference to FIG. 1.

In this embodiment, the first component arrangement 709 comprises a first component arrangement MOSFET having a source terminal, a drain terminal and a gate terminal; a first component arrangement amplifier comprising a first input terminal, a second input terminal and an output terminal; and a first component arrangement diode having an input terminal and an output terminal. The source terminal of the first component arrangement MOSFET comprises the first terminal 710 of the first component arrangement 709, the drain terminal of the first component arrangement MOSFET comprises the second terminal 711 of the first component arrangement 709 and the gate terminal of the first component arrangement MOSFET is coupled to the output terminal of the first component arrangement amplifier. The first input terminal of the first component arrangement amplifier comprises the control terminal 712 of the first component arrangement 709 and the second input terminal of the PTAT amplifier is coupled to the input terminal of the first component arrangement diode. The output terminal of the first component arrangement diode is coupled to both the drain terminal of the first component arrangement MOSFET and the second supply voltage 718.

Figure 14:
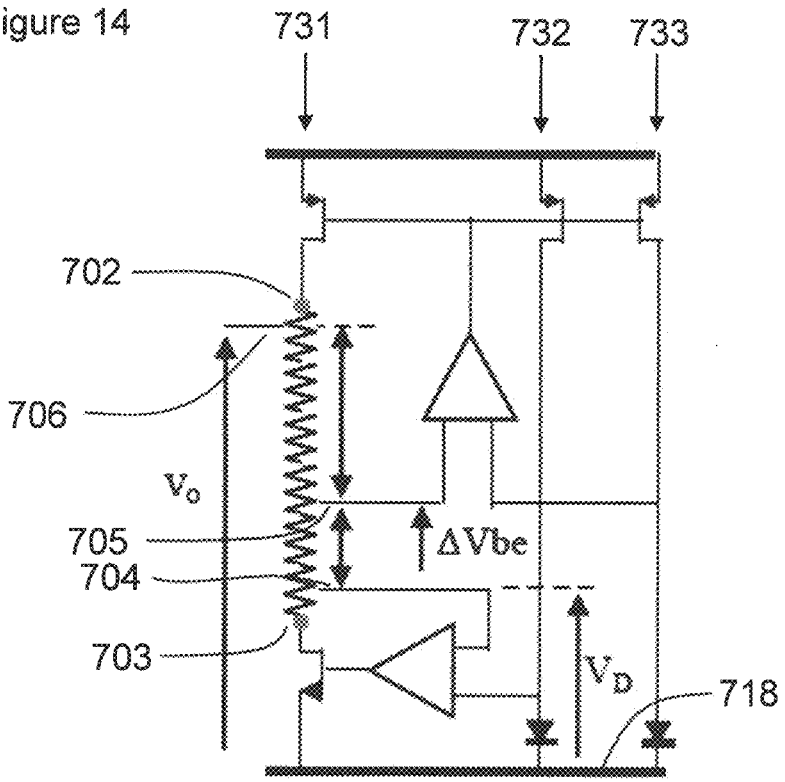
FIG. 14 shows a more detailed schematic representation of the example embodiment of FIG. 13.

As shown in FIG. 14, Further, in this embodiment, there is provided a schematic representation of the circuit of FIG. 13. Once more, in this embodiment, it is necessary to have the same current in each of three branches 731, 732, 733 wherein the first branch comprises the resistive track 701 and the second and third branches 732,733 each comprise one of a first and a second current mirror MOSFET. The source terminals of the first and second current mirror MOSFETs are coupled to the first supply voltage, the gate terminals of each of the first and second current mirror MOSFETs are coupled together and the drain terminals of each of the first and second current mirror MOSFETs are coupled to the input nodes of first and second diodes wherein the first diode comprises first component arrangement diode which comprises the P-N junction of the first component arrangement 709. The output nodes of the first and second diodes are coupled to the second supply voltage 718. The first input terminal of the second component arrangement amplifier is coupled to the second sense contact 705, the second input terminal of the second component arrangement amplifier is coupled to the third branch 733 between the drain terminal of the second current mirror MOSFET and the input node of the second diode. The output terminal of the second component arrangement amplifier is coupled to the gate terminal of the first and second current mirror MOSFETs. The first branch further comprises a first branch MOSFET wherein the gate of the first branch MOSFET is coupled to the gates of the first and second current mirror MOSFETs, the source of the first branch MOSFET is coupled to the first supply voltage and the drain of the first branch MOSFET is coupled to the first force contact 702. By way of the gate-coupled MOSFETs of this embodiment, the current through each of the branches is kept at a constant value. The difference in the current densities at the first input terminal of the first component arrangement amplifier and the first input terminal of the second component arrangement amplifier results in the counter-bias voltage, $\Delta V_{be}$ between the first and second sense contacts. Thus, the compensation of the temperature dependent bias voltage of the P-N junction of the first component arrangement diode allows the voltage reference circuit to provide a constant output voltage between the third sense contact 706 and the second supply voltage 718 which is independent of temperature and contact resistance variations.

Figure 15:
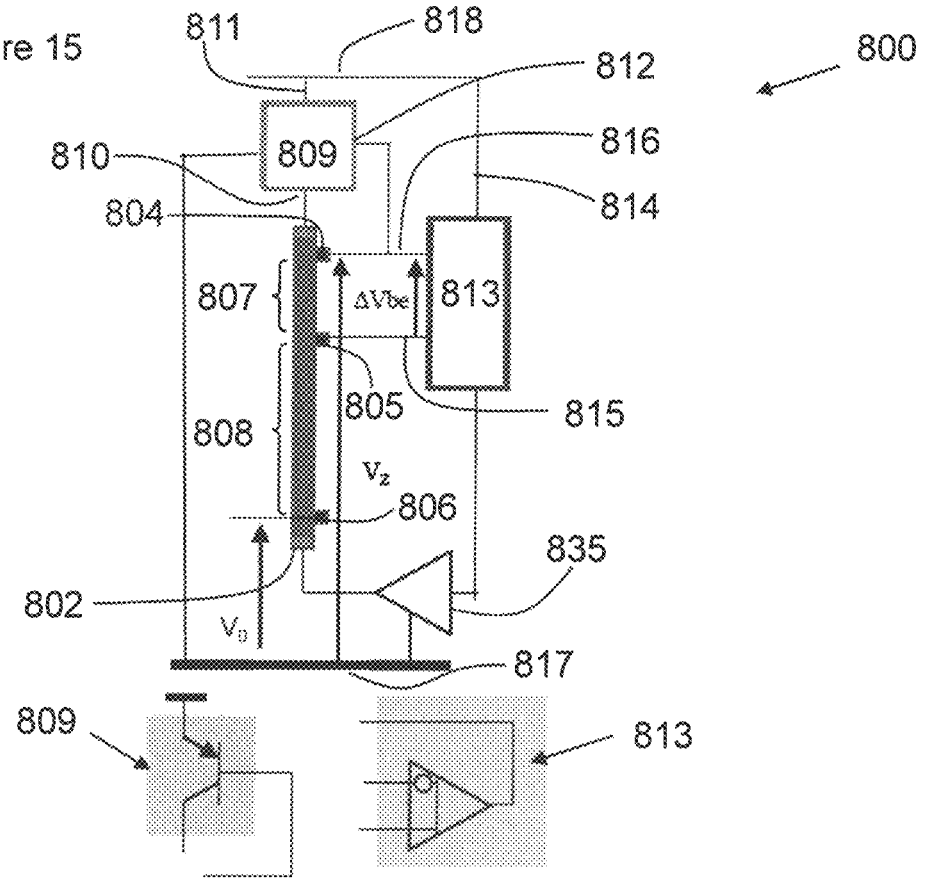
FIG. 15 shows an example embodiment of a Zener voltage reference circuit.

As shown in FIG. 15, in some embodiment voltage reference circuits 800, there may be provided a Zener reference circuit in contrast to the bandgap reference circuits 100, 200, 300, 400, 500, 600, 700 of FIGS. 1-14. In a Zener reference voltage circuit, the reference voltage, $V_0$, is not measured with respect to the bandgap of silicon, but instead with reference to the breakdown voltage of the Zener diode in question. In order to account for the positive temperature coefficient of the Zener diode, it is necessary to provide for a counter-bias voltage, $\Delta V_{be}$ in order to provide for a constant output voltage, $V_0$, which is independent of temperature. Again, this embodiment is also independent of variations in contact resistance because the first and second resistors 807, 808 are defined by the lengths of the first resistor 807 comprising the resistive track 801 between the first and second sense contacts 804, 805 having resistance $R_1$ and the second resistor 808 comprising the resistive track 801 between the second and third sense contacts 805, 806 having resistance $R_2$. In this example, the first component arrangement 809 comprises a PNP first component arrangement BJT having an emitter comprising the second terminal of the first component arrangement 811 coupled to the second reference voltage, a collector comprising the first terminal 810 of the first component arrangement 809 coupled to the second force contact 803 and a base terminal comprising the control terminal 812 of the first component arrangement 809 coupled to the first sense contact 804. The second component arrangement 813 comprises a second component arrangement amplifier having an output node comprising the first terminal 814 of the second component arrangement 813 coupled to the second supply voltage 818, a first input node comprising the second terminal 815 of the second component arrangement 813 coupled to the second sense contact 805 and a second input node comprising the third terminal 816 of the second component arrangement 813 coupled to the first sense contact 804. The output terminal of the second component arrangement amplifier is also coupled to the gate terminal of a MOSFET amplifier 835, the MOSFET amplifier 835 further having a source terminal coupled to the first force contact and a drain terminal coupled to the first voltage supply 817. As has been shown with in relation to the bandgap voltage reference circuits 100, 200, 300, 400, 500, 600, 700 of FIGS. 1-14, it will be appreciated that other components may be used to provide the first component arrangement 809 and the second component arrangement 813.

Figure 16:
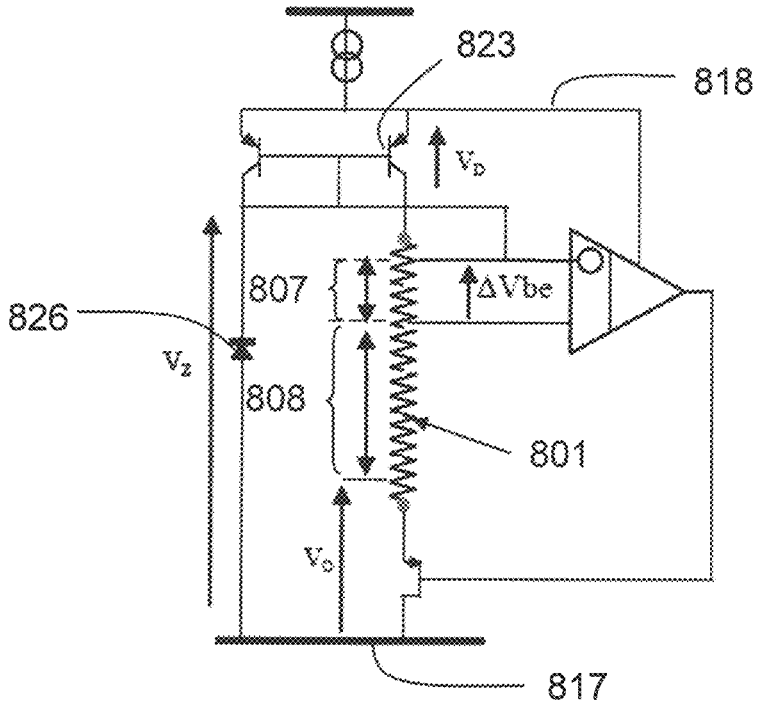
FIG. 16 shows a more detailed schematic representation of the example embodiment of FIG. 15.

As shown in FIG. 16, a schematic representation of the voltage reference circuit 800 of FIG. 15 is provided. In this example, the first component arrangement 809, the first component arrangement BJT forms a current mirror with a further BJT 823 which comprises an emitter terminal coupled to the second reference voltage 818, a collector terminal coupled to the second force contact 803 of the resistive track 801 and a base terminal coupled to the base terminal of the first component arrangement BJT. The current mirror comprising the first component arrangement BJT and the further BJT 823 is configured to force the same current at the first second force contact and the output terminal of the Zener diode. As is also the case for the previous embodiments, because the resistances $R_1$ and $R_2$ of resistors 807, 808 are defined only by the length of the resistive track 801 which defines them and without any contact resistance errors, the ratio $R_2/R_1$ becomes $L_2/L_1$, where $L_2$ is the length of the second resistor 808 and $L_1$ is the length of the first resistor 807.

Because the base of the first component arrangement BJT is coupled to the Zener diode 826, the circuit forces the Zener voltage to that of the first sense contact at a high impedance, meaning the current flow at the first sense contact 804 is low comparatively to the current flow between the first and second force contacts 802, 803. The second component arrangement amplifier provides for $\Delta V_{be}$ between the first and second sense contacts 804, 805 such that the current through the first resistor 807 is equal to $\Delta V_{be}/R_1$. Thus, in this example, the constant output voltage, $V_0$, is measured between the third sense contact 806 and the first reference voltage 817 and is equal to $V_Z-\Delta V_{be}(1-L_2/L_1)$. Where a Zener diode is used, instead of adding a voltage that is proportional to absolute temperature to a voltage that is complimentary to absolute temperature, the proportional to absolute temperature voltage of the counter bias voltage, $\Delta V_{be}$, is subtracted from the proportional to absolute temperature over the Zener diode.

Figure 17:
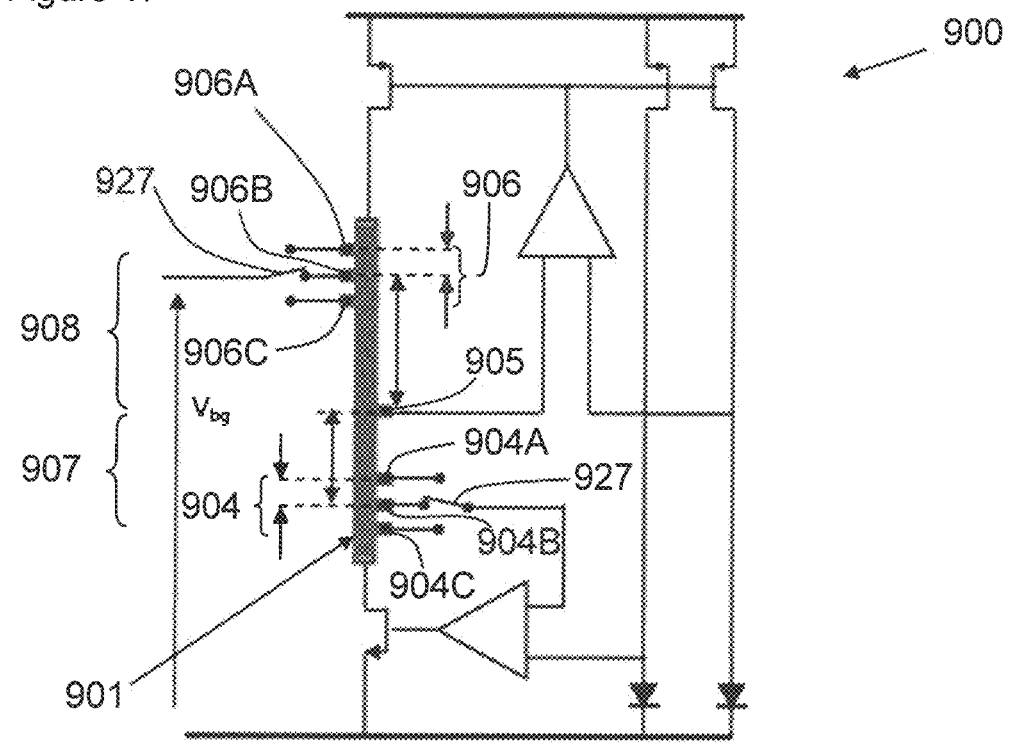
FIG. 17 shows an example embodiment of a bandgap voltage reference circuit having a tunable bandgap.

As shown in FIG. 17, in some embodiments of a voltage reference circuit 900 one or more of the sense contacts 904, 905, 906 may comprise a plurality of sub-sense contacts 904A, 904B, 904C, 906A, 906B, 906C. A first sub-sense contact 904A may be located at a first position along the resistive track 901 and a second sub-sense contact 904B may be positioned at a second position along the resistive track 901. In this example, a third sub-sense contact 904C is provided, although it will be appreciated that in some embodiments, only two sub-sense contacts may be provided for each sense contact 904, 905, 906. A switching apparatus 927 is provided for switching between the sub-sense contacts 904A, 904B, 904C, 906A, 906B, 906C. Because the first resistor 907 is defined by the portion of the resistive track 901 which extends between the first sense contact 904 and the second sense contact 905 and the second resistor 908 is defined by the portion of the resistive track 901 which extends between the third sense contact 906 and the closest of the first and second sense contacts 904, 905, by adjusting the length of either of the resistors 907, 908 by switching between sub-sense contacts, the ratio of $L_2/L_1$, can be tuned, thereby allowing for the tuning of $V_0$.

In the embodiment depicted in FIG. 17, the first and third sense contacts 904, 906 comprise sub-sense contacts 904A, 904B, 904C, 906A, 906B, 906C, however, it will be appreciated that any of the sense contacts 904, 905, 906 may comprise sub-sense contacts 904A, 904B, 904C, 906A, 906B, 906C and that switching between those sub-sense contacts 904A, 904B, 904C, 906A, 906B, 906C would adjust the ratio $L_2/L_1$ and thereby provide for tuning of $V_0$.

In some embodiments, one of the sense contacts 904, 905, 906 may comprise a first plurality of sub-sense contacts 904A-C, 906A-C each separated by a first distance and a different one of the sense contacts 904, 906 may comprise a second plurality of sub-sense contacts 904A-C, 906A-C each separated by a second distance different from the first distance. In an example, where the first distance of separation of the first plurality of sub-sense contacts 904A-C, 906A-C is larger than the second distance of separation of the second plurality of sub-sense contacts 904A-C, 906A-C, switching between the first plurality of sub-sense contacts 904A-C, 906A-C may provide for coarse tuning of the constant output reference voltage and switching between the second plurality of sub-sense contacts 904A-C, 906A-C may provide for fine tuning of the constant output reference voltage. The provision of the plurality of sub-sense contacts 904A, 904B, 904C, 906A, 906B, 906C may be particularly effective because of the high impedance of the sense contact lines.

The embodiment depicted in FIG. 17 comprises a similar structure to that of the voltage reference circuit 700 described with reference to FIG. 14, though with the addition of sub-sense contacts 904A, 904B, 904C, 906A, 906B, at the first and third sense contacts 904, 906. It will be appreciated, however, that the addition of sub-sense contacts may be made to any of the embodiments depicted in FIGS. 1-16.

Figure 18:
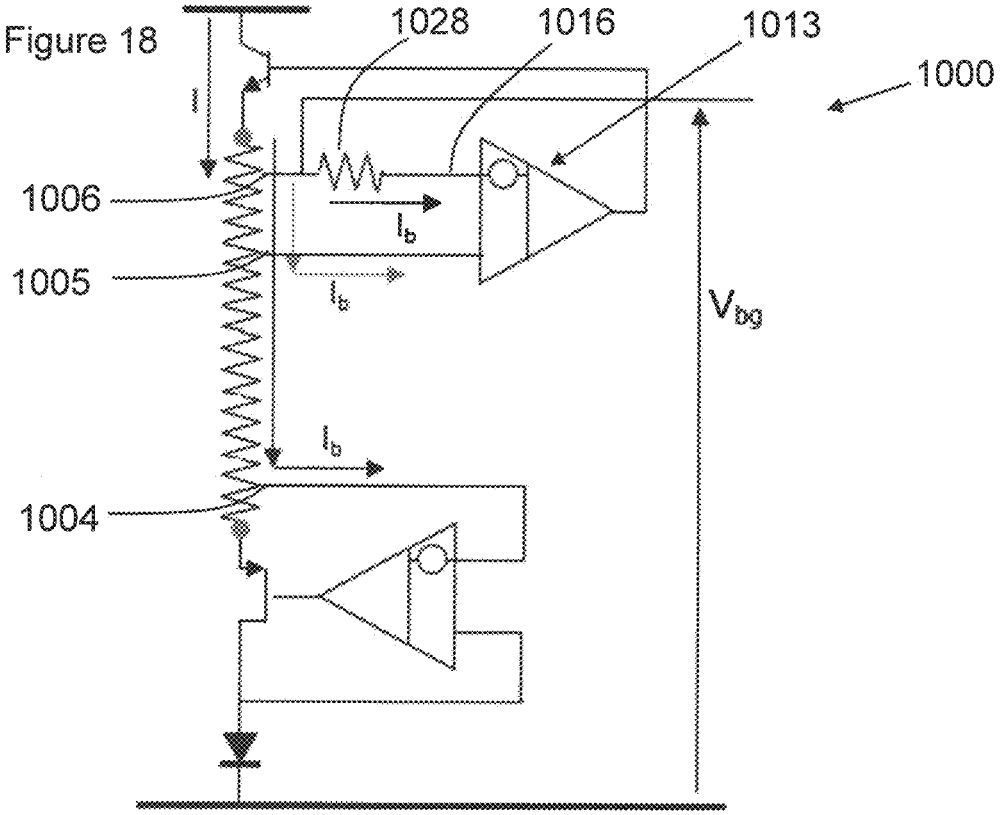
FIG. 18 shows an example embodiment of a bandgap voltage reference circuit having resistance matched sense contacts.

As shown in FIG. 18, in some embodiments, the high impedance at the sense contacts 1004, 1005, 1006 may make it particularly easy to compensate for base current offset of an amplifier. Base current offset arises in a circuit such as that shown in FIG. 18 because the current which flows from the second sense contact to the second input terminal of the second component arrangement has passed through the second resistor and has, hence, undergone a voltage drop. In contrast, the current flowing from the third sense contact to the first input terminal of the second component arrangement amplifier has not undergone this voltage drop. This difference between the signals at the first and second input terminals of the built-in-offset second component arrangement amplifier results in an error to the counter bias voltage, $\Delta V_{be}$, which then results in an error to the constant output voltage of the voltage reference circuit between the third sense contact and the second supply voltage. The errors from contact resistance may exacerbate the errors which arise from base current offsets, which may make base current offsets difficult to accommodate for in voltage reference circuits which do not use a single resistive track to define the resistors therein.

FIG. 18 provides a voltage reference circuit 1000 which is similar in structure to the embodiment described with reference to FIGS. 5 and 6. In the embodiment of FIG. 18, however, a compensation resistor 1028 is added to the second component arrangement 1013 between the third sense contact 1006 and the first input terminal of the second component arrangement amplifier. The compensation resistor 1028 comprises the same, or substantially the same, resistance as the second resistor, which provides for an equal voltage drop between the third sense contact and the first input node of the second component arrangement amplifier as compared to between the second sense contact and the second input terminal of the second component arrangement amplifier. In this way, the base current offset of the amplifier is corrected without the need to worry about varying contact resistances of the second resistor.

There is also disclosed herein a method of making a voltage reference circuit. The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

What is claimed is:

1. A voltage reference circuit comprising:

a resistive track having:

a first force contact for coupling with a first supply voltage, and a second force contact for coupling to a second supply voltage, wherein the second supply voltage is different to the first supply voltage, and the first and second force contacts are configured to pass a current through the resistive track;

a first sense contact, a second sense contact and a third sense contact wherein each of the first, second and third sense contacts are arranged at different positions along the resistive track between the first force contact and the second force contact such that, of the sense contacts, the third sense contact is closest to the first force contact and wherein a first portion of the resistive track comprising the length between the first sense contact and the second sense contact defines a first resistor and a second portion of the resistive track comprising the length between the third sense contact and the closest of the first sense contact and the second sense contact to the third sense contact defines a second resistor;

a first component arrangement having a first terminal coupled to the second force contact of the resistive track; a second terminal for coupling to the second supply voltage; and a control terminal coupled to the first sense contact, the control terminal configured to control the flow of current between the first and second terminals of the first component arrangement based on a voltage at the control terminal, wherein the first component arrangement comprises a P-N junction which has a temperature dependent voltage bias;

a second component arrangement having a first terminal for coupling to one of the first supply voltage and the second supply voltage and a second terminal coupled to the second sense contact;

wherein one or both of the first component arrangement and the second component arrangement provide for a counter-bias voltage over the first or second resistor, the counter bias voltage for countering the temperature dependent voltage bias of the P-N junction and wherein the counter bias voltage is set by the ratio of the first resistance to the second resistance such that the voltage reference circuit is configured to provide a constant output reference voltage between the third sense contact and one of the first and second supply voltages.

2. The voltage reference circuit of claim 1 wherein the first component arrangement comprises a first component arrangement Bipolar Junction Transistor, BJT, wherein the first terminal of the first component arrangement comprises a collector terminal of the first component arrangement BJT, the second terminal of the first component arrangement comprises an emitter terminal of the first component arrangement BJT and the third terminal of the first component arrangement comprises a base terminal of the first component arrangement BJT and wherein the P-N junction of the first component arrangement comprises the base-emitter junction of the first component arrangement BJT.

3. The voltage reference circuit of claim 2 wherein the second component arrangement comprises a second component arrangement BJT, wherein the first terminal of the second component arrangement comprises an emitter terminal of the second component arrangement BJT, the second terminal of the second component arrangement comprises a base terminal of the second component arrangement BJT, and the second component arrangement comprises a third terminal coupled, via a constant current source arrangement to a collector terminal of the second component arrangement BJT and the third terminal of the second component arrangement is for coupling to the other of the first and second supply voltage, the arrangement of the first component arrangement and the second component arrangement such that they together provide for the counter bias voltage between the first sense contact and the second sense contact.

4. The voltage reference circuit of claim 3 wherein the constant current source comprises a current mirror arrangement and the current mirror arrangement comprises a first current mirror BJT and a second current mirror BJT wherein a base of the first current mirror BJT and a base of the second current mirror BJT are coupled together, a collector terminal of the second current mirror BJT is coupled to the collector of the second component arrangement BJT, an emitter terminal of the first current mirror BJT is for coupling to the first supply voltage, an emitter terminal of the second current mirror BJT is for coupling to the first supply voltage and the gate terminals of the first and second current mirror BJTs are further coupled to the collector terminal of one of the first current mirror BJT and the second current mirror BJT.

5. The voltage reference circuit of claim 2 wherein the second component arrangement comprises a second component arrangement amplifier, wherein the first terminal of the second component arrangement comprises an output terminal of the second component arrangement amplifier, the second terminal of the second component arrangement comprises a first input of the second component arrangement amplifier, and the second component arrangement comprises a third terminal coupled to the coupled to one of the first sense contact and the third sense contact, the second component arrangement amplifier comprising a built-in-offset such that the second component arrangement provides for the counter bias voltage between the second and third sense contacts.

6. The voltage reference circuit of claim 2 wherein the second component arrangement comprises a second component arrangement MOSFET having a source terminal, a drain terminal and a gate terminal; a second component arrangement amplifier comprising a first input terminal, a second input terminal and an output terminal; and a second component arrangement diode having an input terminal and an output terminal; and wherein the source terminal of the second component arrangement MOSFET comprises the first terminal of the second component arrangement and is for coupling to the first supply voltage, the drain terminal of the second component arrangement MOSFET is coupled to the first force contact, the gate terminal of the second component arrangement MOSFET is coupled to the output terminal of the second component arrangement amplifier, the first input node of the second component arrangement amplifier comprising the second terminal of the second component arrangement and the second input node of the second component arrangement amplifier comprising a third terminal of the second component arrangement, the third terminal of the second component arrangement coupled to the input node of the second component arrangement diode and the output node of the second component arrangement diode for coupling to the second supply voltage, wherein the arrangement of the first component arrangement and the second component arrangement such that they together provide for the counter bias voltage between the first sense contact and the second sense contact.

7. The voltage reference circuit of claim 2 wherein the voltage reference circuit is a Zener voltage reference circuit and wherein first component arrangement comprises a Zener diode having an output terminal coupled to the base of the first component arrangement BJT and to the first sense contact and the and an input terminal coupled to the first supply voltage.

8. The voltage reference circuit of claim 1 wherein the first component arrangement comprises: a first component arrangement Metal Oxide Semiconductor Field Effect Transistor, MOSFET, having a source terminal, a drain terminal and a gate terminal; a first component arrangement amplifier having a first input terminal, a second input terminal and an output terminal; and a first component arrangement diode having an input terminal and an output terminal, the diode comprising the P-N junction; wherein:

the first terminal of the first component arrangement comprises the source terminal of the first component arrangement MOSFET;

the second terminal of the first component arrangement comprises output terminal of the first component arrangement diode;

the control terminal of the first component arrangement comprises the first input terminal of the first component arrangement amplifier;

the gate terminal of the first component arrangement MOSFET is coupled to the output terminal of the first component arrangement amplifier;

the second input terminal of the first component arrangement amplifier is coupled to the drain terminal of the first component arrangement MOSFET;

the second input terminal of the first component arrangement amplifier is coupled to the input node of the first component arrangement diode and the drain terminal of the first component arrangement MOSFET is coupled to one of the input terminal of the first component arrangement diode and the output terminal of the first component arrangement diode.

9. The voltage reference circuit of claim 1 wherein the voltage reference circuit comprises a bandgap reference circuit and wherein the constant output reference voltage is provided between the third sense contact and the second supply voltage.

10. The voltage reference circuit of claim 1 wherein the resistive track comprises a polysilicon resistive track.

11. The voltage reference circuit of claim 1 wherein the first sense contact comprises a first sub-sense contact located at a first position along the resistive track, a second sub-sense contact positioned at a second position along the resistive track and a first switching apparatus, wherein the first switching apparatus is configured to provide for switching of the first sense contact between the first sub-sense contact and the second sub-sense contact such that the length of the resistive track that provides the first resistor is altered.

12. The voltage reference circuit of claim 11 wherein the distance between the first and second positions of the first sub-sense contact and the second sub-sense contact of the first sense contact is different to the distance between the third and fourth positions of the first sub-sense contact and the second sub-sense contact of the third sense contact.

13. The voltage reference circuit of claim 1 wherein the third sense contact comprises a first sub-sense contact located at a third position along the resistive track, a second sub-sense contact positioned at a fourth position along the resistive track and a second switching apparatus, wherein the second switching apparatus is configured to provide for switching of the first sense contact between the first sub-sense contact and the second sub-sense contact such that the length of the resistive track that provides the second resistor is altered.

14. The voltage reference circuit of claim 1 wherein the second sense contact comprises a first sub-sense contact located at a fourth position along the resistive track, a second sub-sense contact positioned at a fifth position along the resistive track and a third switching apparatus, wherein the third switching apparatus is configured to provide for switching of the second sense contact between the first sub-sense contact and the second sub-sense contact in order to alter the lengths of both the first and second resistors.

15. The voltage reference circuit of claim 1 further comprising a matching resistor wherein:

the matching resistor is arranged between the first sense contact and the control terminal of the first component arrangement and wherein the matching resistor has a resistance configured to match the voltage drop between the first sense contact and the first component arrangement to that between the second sense contact and the second component arrangement; or the matching resistor is arranged between the third sense contact and a third terminal of the second component arrangement and wherein the matching resistor has a resistance configured to match the voltage drop between the third sense contact and the second component arrangement to that between the second sense contact and the second terminal of the second component arrangement.

16. A semiconductor device comprising:

a voltage reference circuit that includes:

a resistive track having:

a first force contact for coupling with a first supply voltage, and a second force contact for coupling to a second supply voltage, wherein the second supply voltage is different to the first supply voltage, and the first and second force contacts are configured to pass a current through the resistive track;

a first sense contact, a second sense contact and a third sense contact wherein each of the first, second and third sense contacts are arranged at different positions along the resistive track between the first force contact and the second force contact such that, of the sense contacts, the third sense contact is closest to the first force contact and wherein a first portion of the resistive track comprising the length between the first sense contact and the second sense contact defines a first resistor and a second portion of the resistive track comprising the length between the third sense contact and the closest of the first sense contact and the second sense contact to the third sense contact defines a second resistor.

17. The semiconductor device of claim 16 further comprising:

a first component arrangement having a first terminal coupled to the second force contact of the resistive track; a second terminal for coupling to the second supply voltage; and a control terminal coupled to the first sense contact, the control terminal configured to control the flow of current between the first and second terminals of the first component arrangement based on a voltage at the control terminal, wherein the first component arrangement comprises a P-N junction which has a temperature dependent voltage bias;

a second component arrangement having a first terminal for coupling to one of the first supply voltage and the second supply voltage and a second terminal coupled to the second sense contact.

18. The semiconductor device of claim 17 wherein one or both of the first component arrangement and the second component arrangement provide for a counter-bias voltage over the first or second resistor, the counter bias voltage for countering the temperature dependent voltage bias of the P-N junction and wherein the counter bias voltage is set by the ratio of the first resistance to the second resistance such that the voltage reference circuit is configured to provide a constant output reference voltage between the third sense contact and one of the first and second supply voltages.

19. The semiconductor device of claim 17 wherein the first component arrangement comprises a first component arrangement Bipolar Junction Transistor, BJT, wherein the first terminal of the first component arrangement comprises a collector terminal of the first component arrangement BJT, the second terminal of the first component arrangement comprises an emitter terminal of the first component arrangement BJT and the third terminal of the first component arrangement comprises a base terminal of the first component arrangement BJT and wherein the P-N junction of the first component arrangement comprises the base-emitter junction of the first component arrangement BJT.

20. The semiconductor device of claim 17 wherein the first component arrangement comprises: a first component arrangement Metal Oxide Semiconductor Field Effect Transistor, MOSFET, having a source terminal, a drain terminal and a gate terminal; a first component arrangement amplifier having a first input terminal, a second input terminal and an output terminal; and a first component arrangement diode having an input terminal and an output terminal, the diode comprising the P-N junction; wherein:

the first terminal of the first component arrangement comprises the source terminal of the first component arrangement MOSFET;

the second terminal of the first component arrangement comprises output terminal of the first component arrangement diode;

the control terminal of the first component arrangement comprises the first input terminal of the first component arrangement amplifier;

the gate terminal of the first component arrangement MOSFET is coupled to the output terminal of the first component arrangement amplifier;

the second input terminal of the first component arrangement amplifier is coupled to the drain terminal of the first component arrangement MOSFET;

the second input terminal of the first component arrangement amplifier is coupled to the input node of the first component arrangement diode and the drain terminal of the first component arrangement MOSFET is coupled to one of the input terminal of the first component arrangement diode and the output terminal of the first component arrangement diode.

* * * * *